US010899123B2

(12) United States Patent
Muraoka

(10) Patent No.: US 10,899,123 B2
(45) Date of Patent: Jan. 26, 2021

(54) ACTIVATION DEVICE FOR A PRINTING BLANKET AND PRINTING METHOD USING A PRINTING BLANKET

(71) Applicant: SHUHOU CO., LTD., Fukui (JP)

(72) Inventor: Kouji Muraoka, Fukui (JP)

(73) Assignee: SHUHOU CO., LTD., Fukui (JP)

( * ) Notice: Subject to any disclaimer, the term of this patent is extended or adjusted under 35 U.S.C. 154(b) by 468 days.

(21) Appl. No.: 15/735,792

(22) PCT Filed: Oct. 24, 2016

(86) PCT No.: PCT/JP2016/081451
§ 371 (c)(1),
(2) Date: Dec. 12, 2017

(87) PCT Pub. No.: WO2018/078694
PCT Pub. Date: May 3, 2018

(65) Prior Publication Data

US 2020/0039207 A1 Feb. 6, 2020

(51) Int. Cl.
*B41F 30/04* (2006.01)
*B41F 31/26* (2006.01)
(Continued)

(52) U.S. Cl.
CPC ..... *B41F 30/04* (2013.01); *B41F 31/26* (2013.01); *B41F 35/06* (2013.01); *B41M 1/40* (2013.01); *B41N 3/006* (2013.01)

(58) Field of Classification Search
CPC .. B41F 3/00; B41F 35/00; B41F 35/003–008; B41F 31/00; B41F 35/02;
(Continued)

(56) References Cited

U.S. PATENT DOCUMENTS 4,920,880 A * 5/1990 Hara ..... B41F 35/06 101/423
5,404,819 A * 4/1995 Hishinuma ..... B41F 35/06 101/425

(Continued)

FOREIGN PATENT DOCUMENTS

EP 2511096 * 10/2012 ..... B41F 35/00
JP 2002-264302 * 9/2002 ..... B41F 35/00

(Continued)

OTHER PUBLICATIONS

International Search Report (ISR) and Written Opinion (WO) dated Dec. 13, 2016 for International Application No. PCT/JP2016/081451.

(Continued)

*Primary Examiner* — Matthew G Marini
*Assistant Examiner* — Marissa Ferguson-Samreth
(74) *Attorney, Agent, or Firm* — Ladas & Parry LLP

(57) ABSTRACT

Provided is an activation device for a printing blanket and a printing method using a printing blanket that enable a surface of an absorber to be constantly kept clean to enable proper activation of a surface of the printing blanket. The activation device for a printing blanket includes a storage tank having a box shape, the absorber mounted on the storage tank, and a liquid stored in the storage tank. The absorber includes layers of absorbing members and absorbs the liquid from an absorber lower part, and an uppermost layer of the absorber is peelable from the absorber.

8 Claims, 5 Drawing Sheets

(51) Int. Cl.
*B41F 35/06* (2006.01)
*B41M 1/40* (2006.01)
*B41N 3/00* (2006.01)

(58) Field of Classification Search
CPC ..... B41F 35/04; B41F 35/06; B41P 2235/00; B41P 2235/24; B41P 2235/21; B41P 2235/242; B41P 2235/244; B41P 2235/246; B41N 3/006; B41N 31/006; B41N 31/00; B41M 1/40
USPC ..... 101/423–425
See application file for complete search history.

(56) References Cited

U.S. PATENT DOCUMENTS 5,479,857 A * 1/1996 Braun ..... B41F 35/06 101/423
5,762,000 A * 6/1998 Detmers ..... B41F 35/02 101/424
5,836,250 A * 11/1998 Herrmann ..... B41F 35/00 101/483
6,341,556 B1 * 1/2002 Endo ..... B41F 9/1018 101/155
6,626,106 B2 * 9/2003 Peckham ..... H05K 3/1233 101/424
6,626,107 B2 * 9/2003 Fuseki ..... B41F 35/00 101/423
6,923,312 B2 * 8/2005 Pham ..... B41J 11/007 101/424
2001/0013296 A1 * 8/2001 Ghisalberti ..... B41F 35/00 101/424
2001/0047561 A1 * 12/2001 Hara ..... B41F 35/00 15/256.51
2015/0158321 A1 6/2015 Muraoka

FOREIGN PATENT DOCUMENTS

JP 2002-264302 A 9/2002
JP 2006-264893 * 10/2006 ..... B65H 5/00
JP 2006-264893 A 10/2006
JP 2009-189418 * 8/2009 ..... A47K 17/02
JP 2009-189418 A 8/2009
JP 2014-4308 A 1/2014
JP 2014-200916 A 10/2014

OTHER PUBLICATIONS

Espacenet English abstract of JP 2014-200916 A.
Espacenet English abstract of JP 2009-189418 A.
Espacenet English abstract of JP 2014-4308 A.
Korean Office Action with an English translation dated Feb. 14, 2019 in connection with corresponding Korean Patent Application No. KR 10-2017-7034598.
Espacenet English abstract of JP 2006-264893 A.
Espacenet English abstract of JP 2002-264302 A.

* cited by examiner

ACTIVATION DEVICE FOR A PRINTING BLANKET AND PRINTING METHOD USING A PRINTING BLANKET

RELATED APPLICATION

This application is an application under 35 U.S.C. 371 of International Application No. PCT/JP2016/081451 filed on Oct. 24, 2016, the entire contents of which are incorporated herein by reference.

TECHNICAL FIELD

The present invention relates to an activation device for a printing blanket used for printing, and to a printing method using a printing blanket using the activation device.

BACKGROUND ART

A printing method using a printing blanket has been performed in the following manner. A blanket (same as a pad) is pressed against a printing original plate (same as a printing plate) having an ink arranged in a pattern corresponding to a printing pattern so that the ink arranged in the printing pattern is transferred (moved) to the printing blanket. Subsequently, the printing pad is pressed against a surface to be printed so that the transferred ink is transferred (passed) to the surface to be printed. In this manner, the printing pattern is printed on the surface to be printed. In this case, as a technology to prevent degradation in printing quality, there is disclosed the invention involving activating a surface of the printing blanket by applying a solvent or other similar substance to the surface so that the ink is less liable to be solidified (see, for example, Patent Literature 1).

CITATION LIST

Patent Literature

Patent Literature 1: Japanese Unexamined Patent Application Publication No. 2013 75717 2014-200916.

SUMMARY OF INVENTION

Technical Problem

The invention disclosed in Patent Literature 1 can make it difficult for an ink transferred to the surface of the printing blanket to be solidified through a step of applying a solvent of an appropriate amount to the surface of the printing blanket (activation step). The solvent of the appropriate amount is applied to the surface of the printing blanket by pressing the printing blanket against a hygroscopic material containing the solvent or other similar substance. A printing step using the printing blanket is the repetition of the steps of pressing the printing blanket against a printing original plate, pressing the printing blanket against a surface to be printed, cleaning the printing blanket, pressing the printing blanket against a hygroscopic material, and pressing the printing blanket against the printing original plate again. Consequently, there have been problems in that, while the above-mentioned steps are repeated a large number of times, dirt adheres to the surface of the hygroscopic material, and the surface of the hygroscopic material is damaged. When the printing step is repeated under a state in which dirt adheres to the surface of the hygroscopic material, printing is performed with dirt adhering also to the surface of the printing blanket and the printing original plate, resulting in degradation in quality of printing. Further, when the hygroscopic material is replaced because of the adhered dirt and damages on the surface of the hygroscopic material, a replacement operation of the hygroscopic material requires a time, leading to an increase in cost for printing.

The present invention has been made to solve the above-mentioned problems, and an object of the present invention is to provide an activation device for a printing blanket and a printing method using a printing blanket that enable a surface of a hygroscopic material for activating a surface of the printing blanket to be constantly kept clean within a short time even when a printing step using the printing blanket is repeated.

Solution to Problem (1) According to one embodiment of the present invention, there is provided an activation device for a printing blanket, including a storage tank having a box shape, an absorber mounted on the storage tank, and a liquid stored in the storage tank, in which the absorber includes a plurality of layers of absorbing members and absorbs the liquid from an absorber lower part included in the absorber, and in which the absorber includes an uppermost layer that is peelable from the absorber.

(2) According to one embodiment of the present invention, there is provided a printing method using a printing blanket, including causing an ink to adhere to a printing original plate to form a predetermined printing pattern, pressing the printing blanket against the printing original plate having the ink so that the ink is transferred to the printing blanket, pressing the printing blanket having the transferred ink against a surface to be printed so that the transferred ink on the printing blanket is transferred to the surface to be printed, and pressing the printing blanket, after the ink is transferred to the surface to be printed, against a cleaning surface so that the ink remaining on the printing blanket adheres to the cleaning surface, the printing method further including an activation step of pressing the printing blanket, after the printing blanket is pressed against the cleaning surface, against an absorber including a lamination of absorbing members so that a part of a liquid permeating the absorber adheres to or permeates the printing blanket, and an absorber updating step of removing the surface of the absorber to change the surface to a new surface.

Advantageous Effects of Invention

With the activation device for the printing blanket and the printing method using the printing blanket according to one embodiment of the present invention, the surface of the hygroscopic material is constantly kept clean to enable proper activation of the surface of the printing blanket. Consequently, the surface of the printing blanket and the printing original plate are constantly kept clean, with the result that degradation in quality of printing and an increase in cost for printing can be reduced.

DESCRIPTION OF EMBODIMENTS

Embodiment 1

Figure 1:
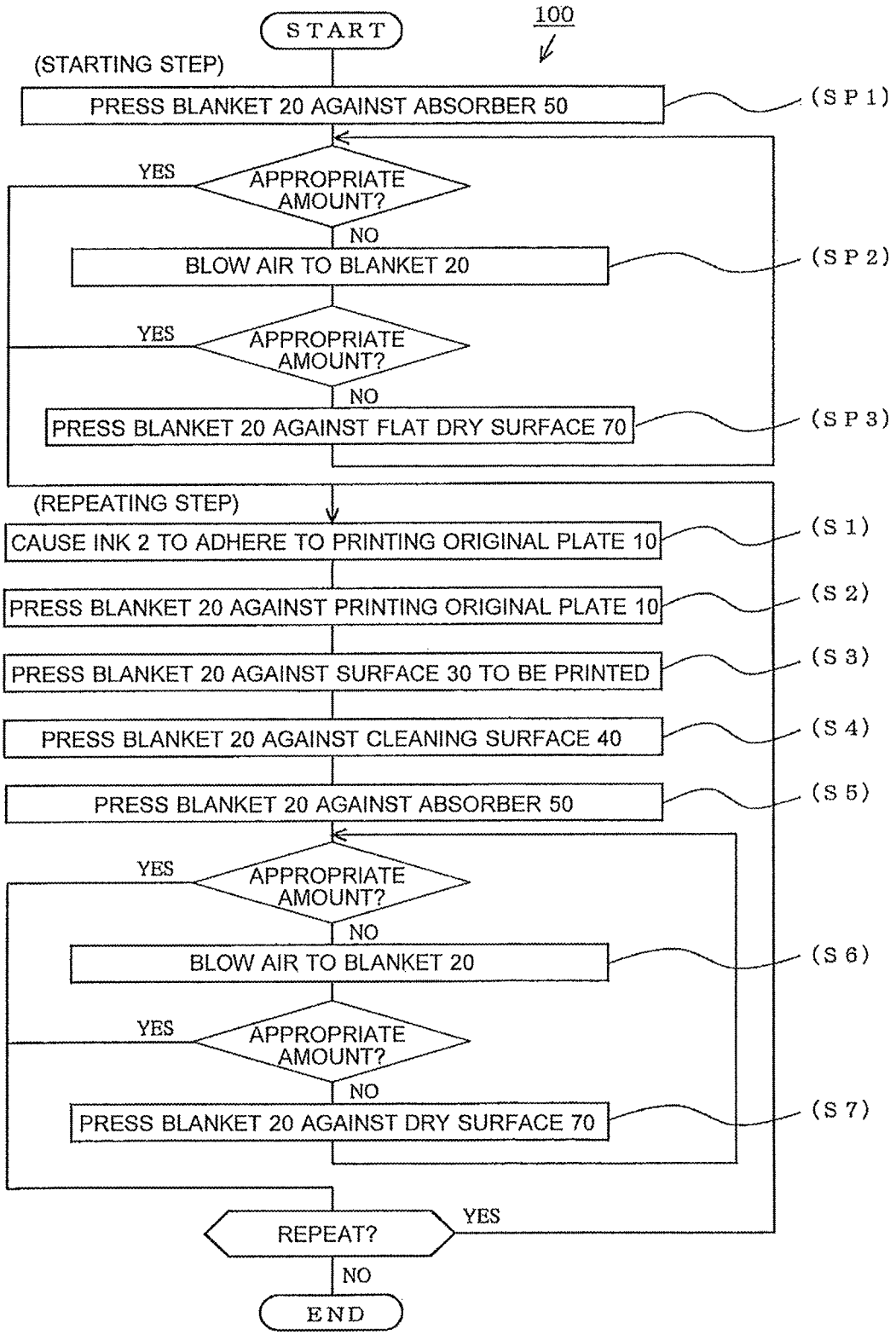
FIG. 1 is a flowchart of a flow of an operation, for illustrating a printing method according to Embodiment 1 of the present invention.

A printing method using an activation device for a surface of a printing blanket according to Embodiment 1 of the present invention is described with reference to FIG. 1 to FIG. 8. FIG. 1 is a flowchart of a flow of an operation, for illustrating a printing method 100 according to Embodiment 1 of the present invention. FIG. 2 to FIG. 8 are each a side view for schematically illustrating a situation of the operation. In FIG. 1, the printing method 100 using a printing blanket 20 includes a starting step and a repeating step.

(Starting Step)

The starting step includes a first starting step (SP1) of pressing the printing blanket 20 against an absorber 50 so that a part of water or a solvent permeating the absorber 50 adheres to or permeates the printing blanket 20, a second starting step (SP2) of blowing air to the printing blanket 20, which the part of the water or the solvent adheres to or permeates, with an air-blowing unit 60, to thereby remove the part of the water or the solvent, and a third starting step (SP3) of pressing the printing blanket 20 against a flat dry surface 70, to thereby remove the part of the water or the solvent adhering to or permeating the printing blanket 20.

When water or a solvent of an appropriate amount adheres to or permeates the printing blanket 20, one or both of the second starting step (SP2) and the third starting step (SP3) may be omitted.

(Repeating Step)

When it is determined that the water or the solvent adheres to or permeates the surface of the printing blanket 20, and the starting step is completed, the flow proceeds to the repeating step. The repeating step includes a first step (S1) of causing an ink 2 to adhere to a printing original plate 10 to form a predetermined printing pattern 1, a second step (S2) of pressing the printing blanket 20 against the printing original plate 10 having the ink 2 in the printing pattern 1 so that the ink 2 is transferred to the printing blanket 20, a third step (S3) of pressing the printing blanket 20 having the transferred ink 2 against a surface 30 to be printed so that the transferred ink 2 on the printing blanket 20 is transferred to the surface 30 to be printed, and a fourth step (S4) of pressing the printing blanket 20, after the ink 2 is transferred to the surface 30 to be printed, against a flat cleaning surface 40 so that the ink 2 remaining on the printing blanket 20 adheres to the cleaning surface 40.

Further, the repeating step includes a fifth step (S5) of pressing the printing blanket 20, after the remaining ink 2 adheres to the cleaning surface 40, against the absorber 50 so that a part of water or a solvent permeating the absorber 50 adheres to or permeates the printing blanket 20, a sixth step (S6) of blowing air to the printing blanket 20, which the part of the water or the solvent adheres to or permeates, with the air-blowing unit 60, to thereby remove the part of the water or the solvent, and a seventh step (S7) of, after the fifth step (S5) or the sixth step (S6), further pressing the printing blanket 20 against the flat dry surface 70, to thereby remove the part of the water or the solvent adhering to or permeating the printing blanket 20. When water or a solvent of an appropriate amount adheres to or permeates the printing blanket 20, one or both of the sixth step (S6) and the seventh step (S7) may be omitted.

(First Step)

The first step is described with reference to FIG. 2(*a*) to FIG. 2(*d*).

In the first step, the manner, in which the ink 2 is caused to adhere to the printing original plate 10 to have the predetermined printing pattern 1, is not limited, and may be relief printing, intaglio printing, or inkjet printing. In FIG. 2(*a*), there is illustrated a state in which the ink 2 is applied to the printing original plate 10 through relief printing as an example. The ink 2 is applied to a substantially entire surface of the printing original plate 10 to a uniform thickness, and the ink 2 applied to the substantially entire surface is partially removed, to thereby cause the remaining ink 2 to have the printing pattern 1. In FIG. 2, the thickness of the ink 2 is emphasized and represented by the hatched lines. The ink 2 may be partially repelled, for example, by causing water or other liquids to permeate the printing original plate 10 in conformity with the printing pattern 1 or forming a silicon layer on the printing original plate 10.

Figure 2:
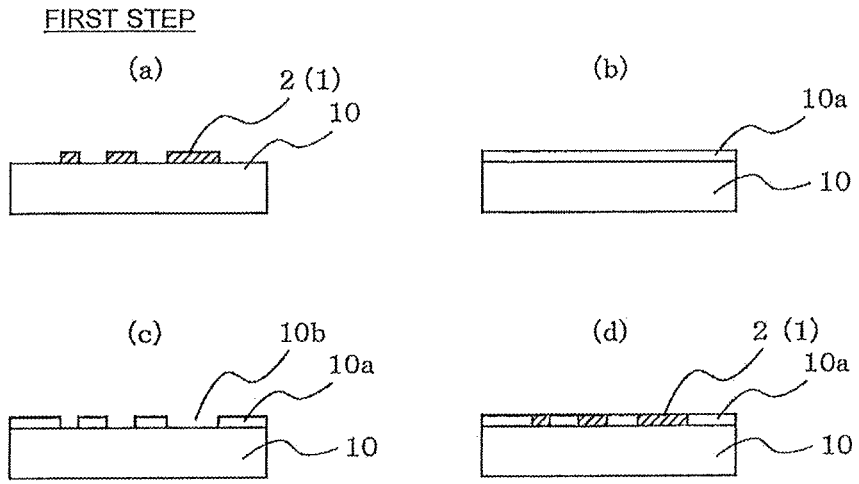
FIG. 2 are each a side view for illustrating a situation (first step) of the operation corresponding to the flow of the operation illustrated in FIG. 1.

FIG. 2(*b*) to FIG. 2(*d*) are views for illustrating steps of applying the ink 2 to the printing original plate 10 through intaglio printing as an example. FIG. 2(*b*) is a view for illustrating a state in which a masking material 10*a* is set on the entire surface of the printing original plate 10. FIG. 2(*c*) is a view for illustrating a state in which recessed portions 10*b* corresponding to the printing pattern 1 are formed in the masking material 10*a*. FIG. 2(*d*) is a view for illustrating a state in which the ink 2 is filled into the recessed portions 10*b*. The masking material 10*a* illustrated in FIG. 2(*b*) to FIG. 2(*d*) is formed, for example, by removing a printing pattern portion from a silicon layer on the surface of the printing original plate 10. The silicon layer may be partially removed in conformity with the printing pattern 1, to thereby repel the ink 2 partially. The step of applying the ink 2 to the printing original plate 10 is not limited to the above-mentioned methods.

(Second Step)

The second step (S2) is described with reference to FIG. 3(*a*) to FIG. 3(*c*).

Figure 3:
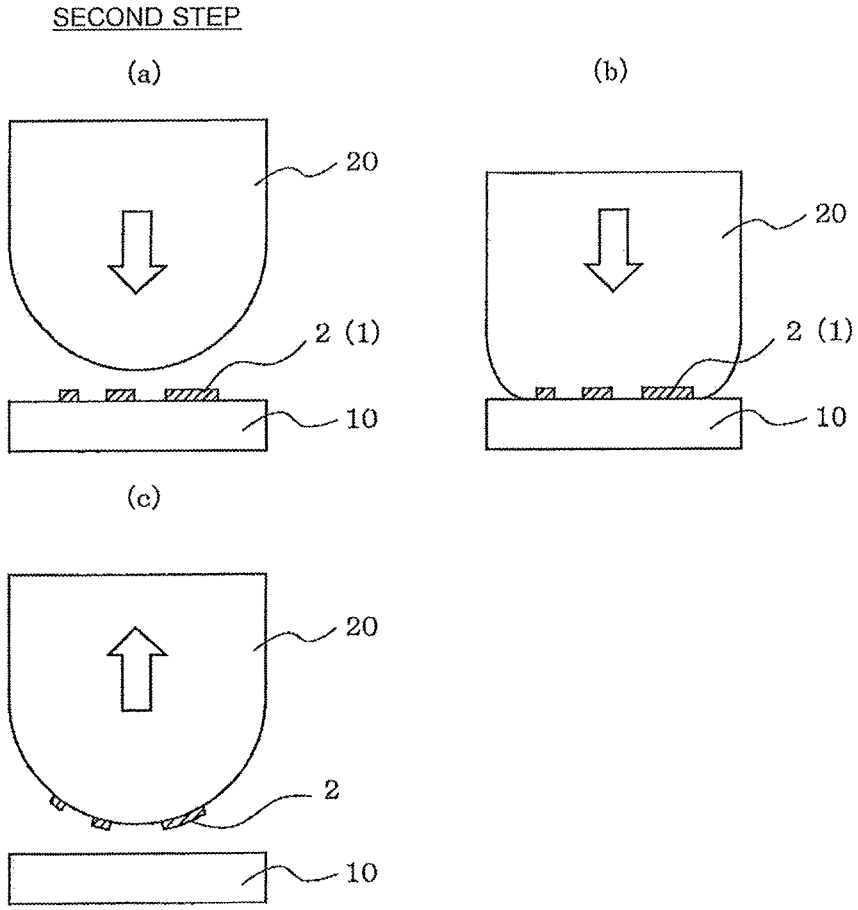
FIG. 3 are each a side view for illustrating a situation (second step) of the operation corresponding to the flow of the operation illustrated in FIG. 1.

As illustrated in FIG. 3(*a*) to FIG. 3(*c*), in the second step (S2), the ink 2 is transferred to the printing blanket 20 in conformity with the printing pattern 1. The printing blanket 20 is pressed against the printing original plate 10 so that the ink 2 is transferred to the surface of the printing blanket 20. To obtain a detailed printing image, it is desired that, as the ink 2, an ink having high viscosity (hardness) be used. Meanwhile, when the ink 2 having high viscosity is used, the ink 2 is less likely to be transferred to the printing blanket. In Embodiment 1, the water or the solvent is applied to the surface of the printing blanket 20, and hence even the ink 2 having high viscosity is likely to be transferred to the surface of the printing blanket 20. With this configuration, printing having high quality without omission of a printing image can be performed. In addition, the ink 2 is less liable to remain on the printing original plate 10, and hence dirt of the printing original plate 10 caused by the remaining ink 2 can be reduced.

(Third Step)

The third step (S3) is described with reference to FIG. 4(*a*) and FIG. 4(*b*).

Figure 4:
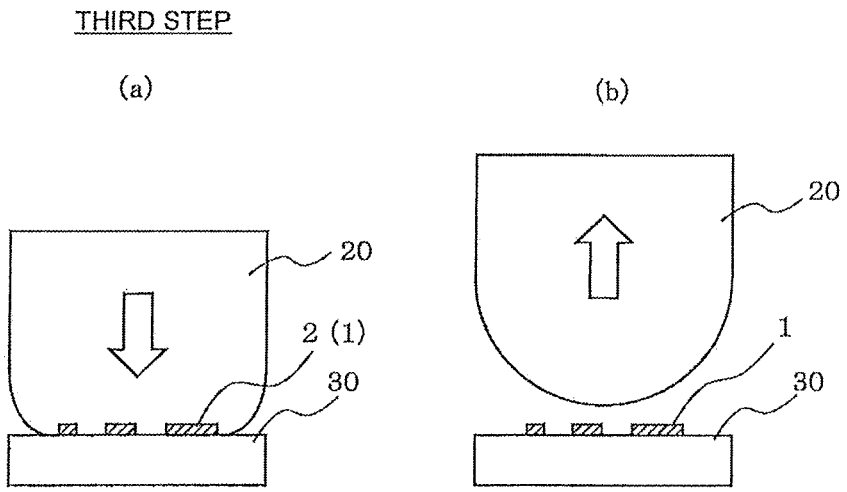
FIG. 4 are each a side view for illustrating a situation (third step) of the operation corresponding to the flow of the operation illustrated in FIG. 1.

As illustrated in FIG. 4(*a*) and FIG. 4(*b*), in the third step (S3), the printing blanket 20 having the transferred ink 2 is pressed against the surface 30 to be printed so that the transferred ink 2 on the printing blanket 20 is transferred to the surface 30 to be printed. Although a flat surface is illustrated as the surface 30 to be printed, the present invention is not limited to this example, and the surface 30 to be printed may be a non-flat surface (curved surface).

(Fourth Step)

The fourth step (S4) is described with reference to FIG. 5.

Figure 5:
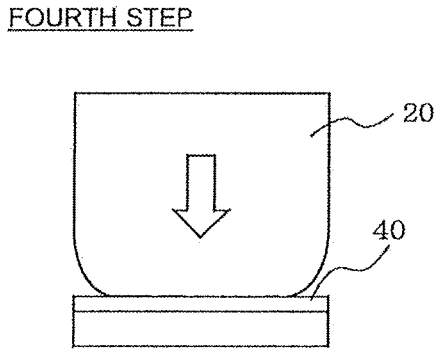
FIG. 5 is a side view for illustrating a situation (fourth step) of the operation corresponding to the flow of the operation illustrated in FIG. 1.

As illustrated in FIG. 5, in the fourth step (S4), the printing blanket 20, after the ink 2 is transferred to the surface 30 to be printed, is pressed against the flat cleaning surface 40 so that the ink 2 remaining on the printing blanket 20 adheres to the cleaning surface 40. The cleaning surface 40 is paper or a pressure-sensitive adhesive tape as an example, but the cleaning surface 40 is not limited to this example.

The fifth step (S5) is described with reference to FIG. 6.

Figure 6:
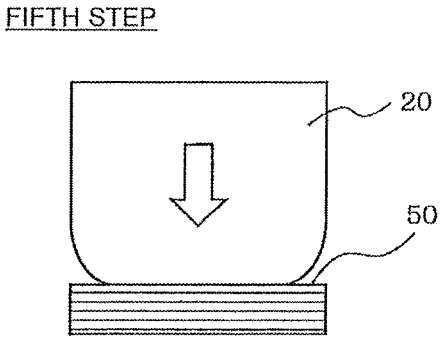
FIG. 6 is a side view for illustrating a situation (fifth step) of the operation corresponding to the flow of the operation illustrated in FIG. 1.

As illustrated in FIG. 6, in the fifth step (S5), the printing blanket 20 having been cleaned is pressed against the absorber 50 so that the part of the water or the solvent permeating the absorber 50 adheres to or permeates the printing blanket 20. This step is referred to as an activation step. The absorber 50 is, for example, a lamination of paper permeated (impregnated) with water or a solvent. Further, the solvent is appropriately selected corresponding to the properties of the ink 2, and may be, for example, thinner, xylene, or toluene having a property of softening the hard ink 2. However, the solvent is not limited to this example. An activation device 80 configured to activate the surface of the printing blanket 20 is described later in detail.

The sixth step (S6) is described with reference to FIG. 7.

Figure 7:
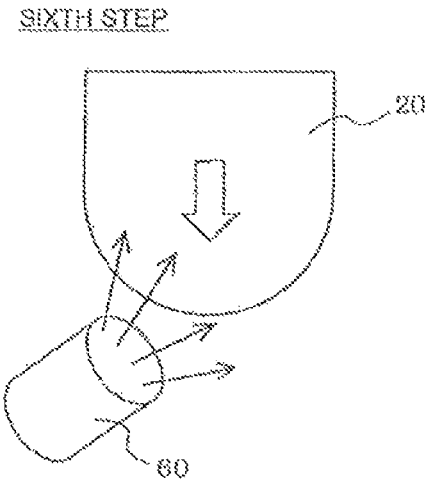
FIG. 7 is a side view for illustrating a situation (sixth step) of the operation corresponding to the flow of the operation illustrated in FIG. 1.

As illustrated in FIG. 7, in the sixth step (S6), air is blown to the printing blanket 20, which the part of the water or the solvent adheres to or permeates, with the air-blowing unit 60, to thereby remove the part of the water or the solvent. There is no limitation on the type and number of the air-blowing units 60, the direction of the air blow, and other conditions.

The seventh step (S7) is described with reference to FIG. 8.

Figure 8:
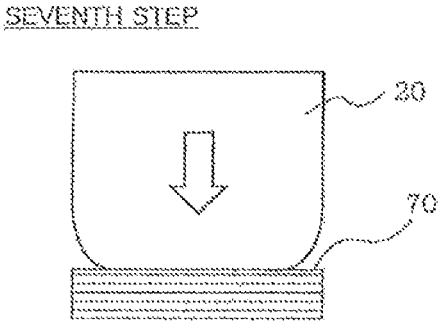
FIG. 8 is a side view for illustrating a situation (seventh step) of the operation corresponding to the flow of the operation illustrated in FIG. 1.

As illustrated in FIG. 8, in the seventh step (S7), the printing blanket 20 is pressed against the flat dry surface 70, to thereby remove the part of the water or the solvent adhering to or permeating the printing blanket 20. The dry surface 70 is a lamination of dried paper, but is not limited to paper as long as the dry surface 70 has hygroscopicity. Further, the dry surface 70 may be one sheet (one layer) instead of a lamination of a plurality of sheets.

The first starting step (SP1), the second starting step (SP2), and the third starting step (SP3) in the starting step are the same as the fifth step (S5), the sixth step (S6), and the seventh step (S7) in the repeating step, respectively, and hence description of the same steps is omitted.

(Regarding Activation Device 80 for Surface of Printing Blanket 20)

Figure 9:
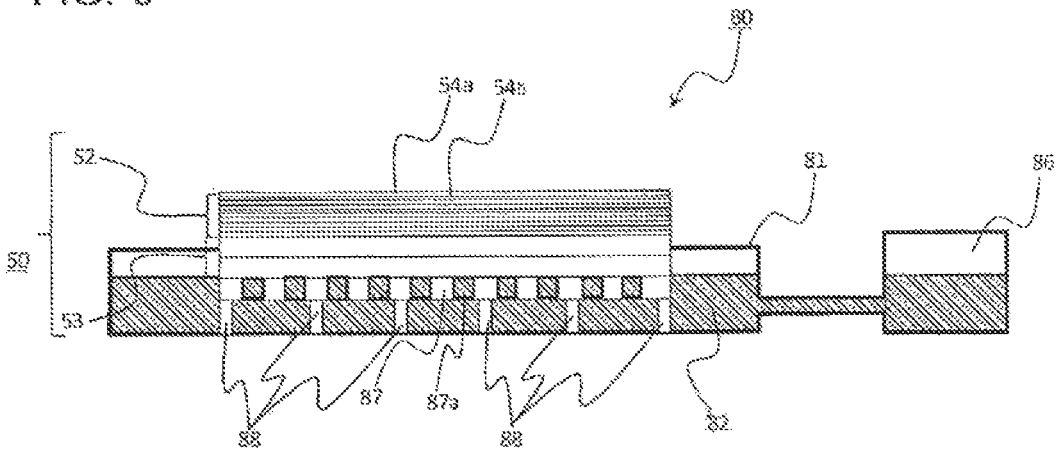
FIG. 9 is a schematic view for illustrating a structure of an activation device according to Embodiment 1 of the present invention.

FIG. 9 is a schematic view for illustrating a structure of the activation device 80 according to Embodiment 1 of the present invention. The activation device 80 includes a storage tank 81 storing a liquid 82. An upper surface side of the storage tank 81 is formed into an open box shape. The absorber 50 is arranged in the storage tank 81. In Embodiment 1, the absorber 50 is mounted on a hole plate 87 in which a plurality of holes 87*a* are formed to allow the liquid 82 to pass through the holes 87*a*. The hole plate 87 is supported by hole plate receiving columns 88, and is arranged at a predetermined distance from a bottom surface of the storage tank 81. The setting of the absorber 50 is not limited to the above-mentioned manner. The absorber 50 may be merely mounted on the bottom surface of the storage tank 81, and for example, may be fixed to be pressed against the bottom surface with a spring or other tools.

In Embodiment 1, the absorber 50 is mounted on the hole plate 87 and sucks the liquid 82 through the holes 87*a*. With the above-mentioned configuration, an absorber lower part 53 of the absorber 50 does not absorb the liquid 82 excessively, and durability of the absorber lower part 53 can be improved. Alternatively, at least a part of the absorber lower part 53 of the absorber 50 may be immersed in the liquid 82 stored in the storage tank 81. In FIG. 9, the absorber 50 is formed by laminating thin sheet-shaped absorbing members. The thickness of the laminated absorbing members is illustrated in an emphasized manner. In Embodiment 1, the absorbing members are formed of paper 54. In Embodiment 1, the paper 54 corresponds to the "absorbing members" according to the invention of the present application. The absorbing members are not limited to the paper 54, and may be formed of another material as long as the material absorbs the liquid 82.

A liquid supply port 86 configured to supply the liquid 82 is connected to the storage tank 81. The liquid supply port 86 is connected to the storage tank 81 through, for example, a pipe. The height of a surface of the liquid 82 stored in the storage tank 81 can be adjusted to a predetermined height by keeping the height of a surface of the liquid 82 of the liquid supply port 86 constant, with the result that the absorber 50 can be adjusted to absorb the liquid 82 properly. The activation device 80 may not include the liquid supply port 86, and the liquid 82 may be supplied to the storage tank 81 with another measure as long as the height of the surface of the liquid 82 can properly be kept.

(Absorber 50)

The absorber 50 is formed of a lamination of the paper 54. In FIG. 9, the absorber lower part 53 of the absorber 50 is formed of a lamination of relatively thick paper. The absorber upper part 52 of the absorber 50 is formed of a lamination of relatively thin paper. The liquid 82 permeates the entire absorber 50 through capillary action of fibers of the paper from the absorber lower part 53 of the absorber 50 that has sucked the liquid 82. The absorber lower part 53 of the absorber 50 is formed of, for example, a lamination of two sheets of strawboard having a thickness of about 2.5 mm. The thick strawboard is inexpensive and is less liable to be dissolved in the liquid 82 even when the thick strawboard is immersed in the liquid 82 for a long time. Consequently, the durability of the absorber 50 is improved.

The absorber upper part 52 of the absorber 50 is formed of a lamination of a large number of sheets of paper thinner than the paper forming the absorber lower part 53. The printing blanket 20 is pressed against paper 54*a* positioned in an uppermost layer of the absorber upper part 52 so that the liquid 82 permeating the paper 54*a* is applied to the surface of the printing blanket 20. While the printing blanket 20 is pressed against the paper 54*a* positioned in the uppermost layer many times, for example, dirt such as the ink 2 remaining on the surface of the printing blanket 20 adheres to the paper 54*a*, and the surface of the paper 54*a* is scraped and broken in some cases. To solve this problem, the paper 54*a* positioned in the uppermost layer is formed to be peelable and removed from the uppermost layer of the absorber 50. The paper 54*a* positioned in the uppermost layer is peeled from the surface of the absorber 50 through a manual operation of an operator or through use of a tool. When the paper 54*a* is peeled, paper 54*b* positioned under the paper 54*a* is newly positioned in an uppermost layer. A surface of the paper 54*b* is kept clean, and the liquid 82 sufficiently permeates the paper 54*b*. Consequently, the surface of the printing blanket 20 can be activated merely by pressing the surface of the printing blanket 20 against the paper 54*b*.

The absorber upper part 52 of the absorber 50 is formed of a lamination of, for example, ten sheets of thin paper, but the number of sheets is not limited. The number of sheets may appropriately be changed depending on the kind of the paper, the ease of suction of the liquid 82, the kind of the liquid 82, and the frequency of peeling the paper 54 positioned in the uppermost layer. Further, as the absorber lower part 53 of the absorber 50, a material other than strawboard may be used, and a material by which the liquid 82 is absorbed and allowed to permeate, for example, sponge may be used. Further, the portion other than the paper 54 positioned in the uppermost layer may be formed of a material by which the liquid 82 is absorbed and allowed to permeate, for example, sponge.

The step of peeling the paper 54*a* positioned in the uppermost layer of the absorber 50 is referred to as an absorber updating step. The absorber updating step may be performed between any steps in the repetition of Steps S1 to S7 of FIG. 1. Alternatively, the absorber updating step may be performed in parallel with the step other than the fifth step (S5) of pressing the printing blanket 20 against the absorber 50. When the absorber updating step is performed in parallel with the step other than the fifth step (S5), it is not necessary to stop printing even while the absorber updating step is being performed. The time required for performing the absorber updating step does not influence printing, and hence an increase in printing cost can be reduced.

Effects of Embodiment 1

(1) The activation device 80 for the printing blanket 20 according to Embodiment 1 includes the box-shaped storage tank 81, the absorber 50 mounted on the storage tank 81, and the liquid 82 stored in the storage tank 81. The absorber 50 is formed of layers of the absorbing members and absorbs the liquid 82 from the absorber lower part 53. The uppermost layer (paper 54*a*) of the absorber 50 can be peeled from the absorber 50.

(2) The printing method using the printing blanket 20 according to Embodiment 1 includes causing the ink 2 to adhere to the printing original plate 10 to form the predetermined printing pattern 1, pressing the printing blanket 20 against the printing original plate 10 having the ink 2 so that the ink 2 is transferred to the printing blanket 20, pressing the printing blanket 20 having the transferred ink 2 against the surface 30 to be printed so that the transferred ink 2 on the printing blanket 20 is transferred to the surface 30 to be printed, and pressing the printing blanket 20, after the ink 2 is transferred to the surface 30 to be printed, against the cleaning surface 40 so that the ink 2 remaining on the printing blanket 20 adheres to the cleaning surface 40. The printing method includes the activation step of pressing the printing blanket 20, after the printing blanket 20 is pressed against the cleaning surface 40, against the absorber 50 including layers of the absorbing members so that a part of the liquid 82 permeating the absorber 50 adheres to or permeates the printing blanket 20, and the absorber updating step of removing the surface of the absorber 50 to change the surface to a new surface.

With the above-mentioned configuration, in printing using the printing blanket 20, the surface of the absorber 50 is constantly kept clean, and the surface of the printing blanket 20 can properly be activated. When the surface of the printing blanket 20 is activated, the transferability of the ink 2 from the printing original plate 10 to the printing blanket 20 is improved, and in addition, the surface of the printing blanket 20 and the printing original plate 10 are constantly kept clean. As a result, degradation in quality of printing and an increase in cost for printing can be reduced.

(3) In the activation device 80 for the printing blanket 20 according to Embodiment 1, at least the absorber lower part 53 of the absorber 50 may be formed of strawboard, and paper different from the strawboard may be laminated on the strawboard.

With the above-mentioned configuration, the thick strawboard is inexpensive and is less liable to be dissolved in the liquid 82 even when the thick strawboard is immersed in the liquid 82 for a long time. Consequently, the durability of the absorber 50 is improved, and cost can be reduced.

(4) In the printing method using the printing blanket 20 according to Embodiment 1, the absorber updating step includes peeling the paper 54*a* positioned in an uppermost layer of the absorber 50 to expose the paper 54*b* positioned in a layer under the paper 54*a* to an uppermost layer. The paper 54*a* corresponds to one of the absorbing members of the invention of the present application.

With the above-mentioned configuration, the operation of changing the surface of the absorber 50 is easy, and the time required for changing the surface of the absorber 50 is shortened. As a result, the cost for printing can be reduced.

Embodiment 2

An activation device 280 for the surface of the printing blanket 20 according to Embodiment 2 of the present invention automatically changes the paper 54*a* in the uppermost layer of the absorber 50 unlike the activation device 80 according to Embodiment 1. Regarding the activation device 280 for the surface of the printing blanket 20 according to Embodiment 2, a change from Embodiment 1 is mainly described. Each portion of the activation device 280 for the surface of the printing blanket 20 according to Embodiment 2 having the same function in each drawing is illustrated with the same reference sign as that in the drawings used in the description of Embodiment 1.

Figure 10:
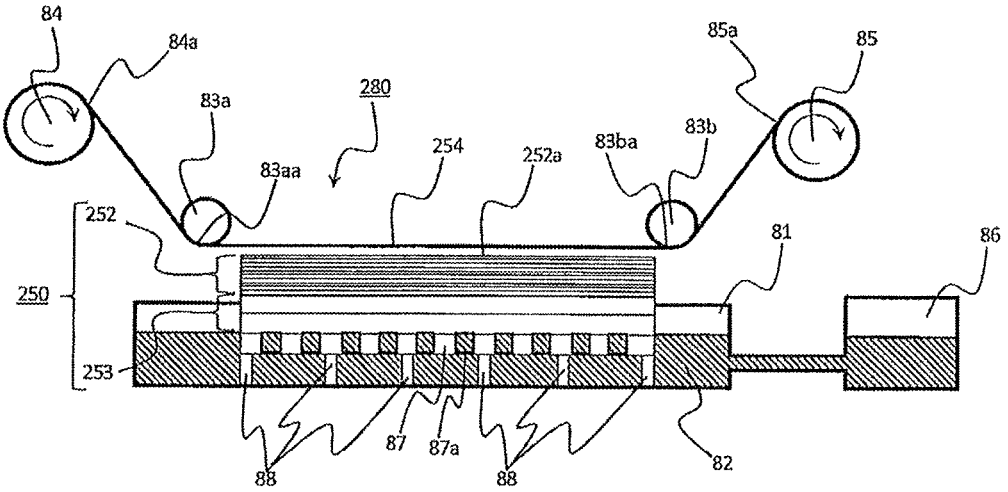
FIG. 10 is a schematic view for illustrating a structure of an activation device according to Embodiment 2 of the present invention.

FIG. 10 is a schematic view for illustrating a structure of the activation device 280 according to Embodiment 2 of the present invention. The activation device 280 for the surface of the printing blanket 20 according to Embodiment 2 has a configuration in which rolled paper 254 in an uppermost layer of an absorber 250 is fed from a feed roll 84, guided by guide rollers 83*a* and 83*b*, and taken up to a take-up roll 85. An absorber upper part 252 formed of, for example, laminated paper is positioned below the rolled paper 254 in the uppermost layer of the absorber 250. Further, an absorber lower part 253 formed of, for example, a lamination of thick strawboard is arranged under the absorber upper part 252. The absorber upper part 252 and the absorber lower part 253, forming the absorber 250, are each formed of a plurality of layers, but are not limited to this configuration. The absorber upper part 252 and the absorber lower part 253 may each be formed of, for example, one layer of an absorbing member. Further, the absorber upper part 252 and the absorber lower part 253 in combination may be formed of, for example, one layer of an absorbing member.

The guide rollers 83*a* and 83*b* are positioned on lateral sides of the uppermost layer of the absorber 250 when the absorber 250 is viewed from an upper side, and are arranged to be opposed to each other across the absorber 250. Lower ends of cylindrical surfaces of the guide rollers 83*a* and 83*b* are positioned above an upper surface of paper 252*a* in the uppermost layer of the absorber upper part 252. The rolled paper 254 guided by the guide rollers 83*a* and 83*b* is arranged with a gap from the paper 252*a* in the uppermost layer of the absorber upper part 252 under a state in which tension is applied between the guide rollers 83*a* and 83*b*. In Embodiment 2, the rolled paper 254 is used, but a roll-shaped absorbing member made of a different material capable of absorbing the liquid 82 may be used instead of the rolled paper 254.

A feed portion 84*a* of the feed roll 84 is positioned above a lower end 83*aa* of the cylindrical surface of the guide roller 83*a*. A take-up portion 85*a* of the take-up roll 85 is positioned also above a lower end 83*ba* of the cylindrical surface of the guide roller 83*b*. With the above-mentioned configuration, when torque is applied to both the feed roll 84 and the take-up roll 85 in a direction of taking up the rolled paper 254 (in FIG. 10, the rotation direction of the feed roll 84 is set to a direction opposite to the illustrated arrows), tension can be applied to the rolled paper 254 guided by the guide rollers 83*a* and 83*b*.

The rolled paper 254 is arranged with a gap from the paper 252*a* in the uppermost layer of the absorber upper part 252 under a state in which tension is applied between the guide rollers 83*a* and 83*b*. Consequently, in the updating step of the absorber 250, the rolled paper 254 is taken up to the take-up roll 85 while tension is applied to the rolled paper 254. In this case, through application of tension resisting the feed roll 84, the rolled paper 254 can be taken up while tension is applied to the rolled paper 254 guided by the guide rollers 83*a* and 83*b*. With the above-mentioned configuration, the rolled paper 254 is sent to the take-up roll 85 side smoothly without being caught by the upper surface of the paper 252*a* in the uppermost layer of the absorber upper part 252. In particular, the rolled paper 254 is in a state wetted with the liquid 82 after use. Consequently, the rolled paper 254 sticks to the paper 252*a* in the uppermost layer of the absorber upper part 252 and cannot be separated from the same paper 252*a*, with the result that it is difficult to move the rolled paper 254 in a horizontal direction of FIG. 10 in some cases. In this case, the rolled paper 254 can be separated in a vertical direction of the paper 252*a* in the uppermost layer of the absorber upper part 252 by applying tension to the rolled paper 254 guided by the guide rollers 83*a* and 83*b*. Subsequently, the rolled paper 254 is sent, and thus the rolled paper 254 in the uppermost layer of the absorber 250 can easily be moved horizontally. Further, when there is no gap between the paper 252*a* in the uppermost layer of the absorber upper part 252 and the rolled paper 254, the guide rollers 83*a* and 83*b* may be configured to move vertically. In this case, the guide rollers 83*a* and 83*b* are moved upward before the rolled paper 254 is sent so that the rolled paper 254 can be separated from the paper 252*a* in the uppermost layer of the absorber upper part 252.

When the rolled paper 254 is taken up to change the surface of the rolled paper 254 in the uppermost layer of the absorber 250, the liquid 82 has not permeated the rolled paper 254 yet. However, the gap between the rolled paper 254 and the paper 252*a* in the uppermost layer of the absorber upper part 252 is small, and hence the liquid 82 permeates the rolled paper 254 from the paper 252*a* when the printing blanket 20 is once pressed against the rolled paper 254. To cause the liquid 82 to permeate the rolled paper 254, the rolled paper 254 may be pressed against the paper 252*a* in the uppermost layer of the absorber upper part 252 by pressing the printing blanket 20 against the rolled paper 254. This step is referred to as a pressing step.

Figure 11:
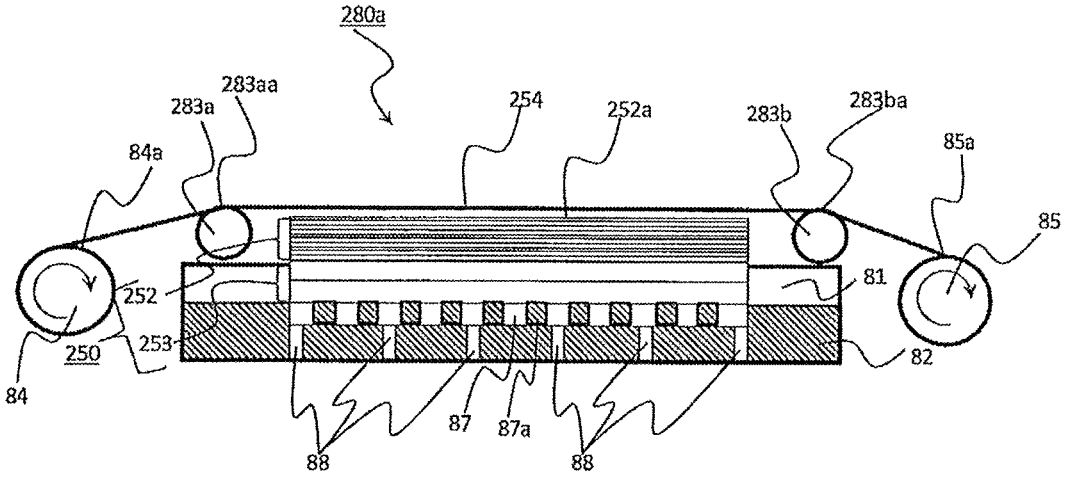
FIG. 11 is a schematic view for illustrating a structure of an activation device as a modification example according to Embodiment 2 of the present invention.

FIG. 11 is a schematic view for illustrating a structure of an activation device 280*a* as a modification example according to Embodiment 2 of the present invention. In the activation device 280*a* upper ends 283*aa* and 283*ba* of a cylindrical surface of guide rollers 283*a* and 283*b* is arranged to be positioned above the paper 252*a* in the uppermost layer of the absorber upper part 252. The rolled paper 254 is arranged to pass through upper sides of the guide rollers 283*a* and 283*b*. Further, the feed portion 84*a* of the feed roll 84 is arranged below the upper end 283*aa* of the cylindrical surface of the guide roller 283*a*, and the take-up portion 85*a* of the take-up roll 85 is arranged also below the upper end 283*ba* of the cylindrical surface of the guide roller 283*b*.

Even with the configuration of the activation device 280*a*, tension can be applied to the rolled paper 254 laid between the guide roller 283*a* and the guide roller 283*b* or the rolled paper 254 can be loosened in the same manner as in the activation device 280. When the rolled paper 254 is arranged on the upper sides of the guide rollers 283*a* and 283*b* as in the activation device 280*a*, in the case where the roll-shaped paper set on the feed roll 84 and the take-up roll 85 is replaced, it is not necessary to cause the rolled paper 254 to pass between the guide rollers 83*a* and 83*b* of FIG. 10 and the paper 252*a* in the uppermost layer of the absorber upper part 252 of FIG. 10, and hence the roll-shaped paper can easily be replaced.

In Embodiment 2, the absorber upper part 252 and the absorber lower part 253 are not limited to the configuration of laminated paper, and may be formed of a material by which the liquid 82 is absorbed and allowed to permeate, for example, sponge. Further, in FIG. 11, the liquid supply port 86 is not illustrated, but the liquid supply port 86 may be connected to the storage tank 81 in the same manner as in FIG. 9 or FIG. 10.

Effects of Embodiment 2

(5) In the activation devices 280 and 280*a* for the printing blanket 20 according to Embodiment 2, the uppermost layer of the absorber 250 is the rolled paper 254 that is fed from the feed roll 84 and taken up to the take-up roll 85.

With the above-mentioned configuration, in printing using the printing blanket 20, the rolled paper 254 positioned in the uppermost layer of the absorber 250 can automatically be changed while the same effects as those of Embodiment 1 are obtained. Further, the updating step for the absorber 250 can be performed in parallel with the printing.

(6) The activation device 280 for the printing blanket 20 according to Embodiment 2 further includes the guide rollers 83*a* and 83*b* on the lateral sides of the end portions of the uppermost surface of the absorber upper part 252. The lower ends 83*aa* and 83*ba* of the cylindrical surfaces of the guide rollers 83*a* and 83*b*, which guide the rolled paper 254, are positioned above an imaginary plane extending the uppermost surface of the absorber upper part 252 to the lateral sides. The feed portion 84*a* of the feed roll 84 for the rolled paper 254 and the take-up portion 85*a* of the take-up roll 85 for the rolled paper 254 are positioned above the lower ends 83*aa* and 83*ba* of the cylindrical surfaces. The rolled paper 254 according to Embodiment 2 corresponds to a part of one of the absorbing members of the invention of the present application.

With the above-mentioned configuration, the rolled paper 254 is sent to the take-up roll 85 side smoothly without being caught by the surface of the paper 252*a* in the uppermost layer of the absorber upper part 252. In particular, the rolled paper 254 is in a state wetted with the liquid 82 after use. Consequently, the rolled paper 254 sticks to the paper 252*a* in the uppermost layer of the absorber upper part 252 and cannot be separated from the same paper 252*a*, with the result that it is difficult to move the rolled paper 254 in the horizontal direction of FIG. 10 in some cases. In this case, the rolled paper 254 can be separated in the vertical direction of the paper 252*a* in the uppermost layer of the absorber upper part 252 by applying tension to the rolled paper 254 guided by the guide rollers 83*a* and 83*b* or by moving the guide rollers 83*a* and 83*b* upward. Subsequently, the rolled paper 254 is sent, and thus the rolled paper 254 immediately above the paper 252*a* in the uppermost layer of the absorber upper part 252 can easily be moved horizontally.

(7) The activation device 280*a* for the printing blanket 20 according to Embodiment 2 further includes the guide rollers 283*a* and 283*b* on the lateral sides of the end portions of the uppermost surface of the absorber upper part 252. The upper ends 283*aa* and 283*ba* of the cylindrical surfaces of the guide rollers 283*a* and 283*b*, which guide the rolled paper 254, are positioned above the imaginary plane extending the uppermost surface of the absorber upper part 252 to the lateral sides. The feed portion 84*a* of the feed roll 84 for the rolled paper 254 and the take-up portion 85*a* of the take-up roll 85 for the rolled paper 254 are positioned below the upper ends 283*aa* and 283*ba* of the cylindrical surfaces. The rolled paper 254 according to Embodiment 2 corresponds to a part of one of the absorbing members of the invention of the present application.

With the above-mentioned configuration, the activation device 280*a* exhibits the same effects as those of the above-mentioned section (6). In addition, when the roll-shaped paper set on the feed roll 84 and the take-up roll 85 is replaced, it is not necessary to cause the rolled paper 254 to pass through a region between the guide rollers 83*a* and 83*b* and the paper 252*a* in the uppermost layer of the absorber upper part 252 of FIG. 10, and hence the roll-shaped paper can easily be replaced.

(8) The printing method using the printing blanket 20 according to Embodiment 2 includes the absorber updating step of taking up the rolled paper 254 positioned in the uppermost layer of the absorber 250, which is fed from the feed roll 84 and taken up to the take-up roll 85, and supplying the rolled paper 254 fed from the feed roll 84 to the uppermost layer of the absorber 250.

With the above-mentioned configuration, the same effects as those of the above-mentioned section (6) can be obtained through use of the activation devices 280 and 280*a* for the printing blanket 20 in the printing method.

(9) The printing method using the printing blanket 20 according to Embodiment 2 further includes the pressing step of pressing from above the rolled paper 254 fed from the feed roll 84 against the paper 252*a* positioned in the uppermost layer of the absorber 250.

With the above-mentioned configuration, the rolled paper 254 positioned above the paper 252*a* in the uppermost layer of the absorber 250 is automatically changed, and in addition, the liquid 82 can be caused to permeate the rolled paper 254 quickly after the rolled paper 254 is changed. Further, the step of causing the liquid 82 to permeate the rolled paper 254 can also be automated.

INDUSTRIAL APPLICABILITY

According to the present invention, even when printing using the printing blanket is repeatedly performed through use of hard ink, both transferability and cleanliness of the printing original plate can be kept. Consequently, the present invention can widely be used as a printing method using blankets having various shapes and various sizes.

REFERENCE SIGNS LIST

1 printing pattern 2 ink 10 printing original plate 10*a* masking material 10*b* recessed portion 20 printing blanket 30 surface to be printed 40 cleaning surface 50 absorber 52 absorber upper part 53 absorber lower part 54 paper 55 paper 60 air-blowing unit 70 dry surface 80 activation device 81 storage tank 82 liquid 83*a* guide roller 83*aa* lower end 83*ab* upper end 83*b* guide roller 83*ba* lower end

83*bb* upper end 84 feed roll 84*a* feed portion 85 take-up roll

85*a* take-up portion 86 liquid supply port 87 hole plate 87*a* hole 88 hole plate receiving column 100 printing method 250 absorber

252 absorber upper part 252*a* paper (in uppermost layer of absorber upper part 252) 253 absorber lower part 254 rolled paper 280 activation device 280*a* activation device 283*a* guide roller 283*aa* upper end 283*b* guide roller 283*ba* upper end

The invention claimed is:

1. An activation device for a printing blanket, comprising:

a storage tank having a box shape;

an absorber mounted on the storage tank;

and a liquid stored in the storage tank, the absorber including layers of absorbing members and absorbing the liquid from an absorber lower part included in the absorber, the absorber including an uppermost layer and an absorber upper part fixedly positioned immediately below the uppermost layer, the uppermost layer being one of the absorbing members that is fed from a feed roll and taken up to a take-up roll, wherein the uppermost layer is separated from the absorber upper part by a gap;

wherein the uppermost layer is configured and arranged to move vertically toward the absorber upper part when the printing blanket is pressed vertically against the uppermost layer; and wherein the gap is small enough such that the uppermost layer abuts the absorber upper part and causes liquid from the absorber upper part to permeate the uppermost layer when the printing blanket is pressed vertically against the uppermost layer.

2. The activation device for a printing blanket of claim 1, wherein the activation device further includes a guide roller on a lateral side of an uppermost surface of the absorber upper part, wherein the guide roller has a lower end of a cylindrical surface configured to guide one of the absorbing members, the lower end being positioned above an imaginary plane extending the uppermost surface of the absorber upper part to the lateral side, and wherein the feed roll includes a feed portion configured to feed the one of the absorbing members, and the take-up roll includes a take-up portion configured to take up the one of the absorbing members, the feed portion and the take-up portion being positioned above the lower end of the cylindrical surface.

3. The activation device for a printing blanket of claim 1, wherein the activation device further includes a guide roller on a lateral side of an uppermost surface of the absorber upper part, wherein the guide roller has an upper end of a cylindrical surface configured to guide one of the absorbing members, the upper end being positioned above an imaginary plane extending the uppermost surface to the lateral side, and wherein the feed roll includes a feed portion configured to feed the one of the absorbing members, and the take-up roll includes a take-up portion configured to take up the one of the absorbing members, the feed portion and the take-up portion being positioned below the upper end of the cylindrical surface.

4. The activation device for a printing blanket of claim 3, wherein at least the absorber lower part of the absorber includes strawboard, and paper different from the strawboard is laminated on the strawboard.

5. The activation device for a printing blanket of claim 1, wherein the absorbing members include paper.

6. A printing method using a printing blanket, comprising:

causing an ink to adhere to a printing original plate to form a predetermined printing pattern;

pressing the printing blanket against the printing original plate having the ink so that the ink is transferred to the printing blanket;

pressing the printing blanket having the transferred ink against a surface to be printed so that the transferred ink on the printing blanket is transferred to the surface to be printed; and pressing the printing blanket, after the ink is transferred to the surface to be printed, against a cleaning surface so that the ink remaining on the printing blanket adheres to the cleaning surface, the printing method further comprising:

pressing the printing blanket, after the printing blanket is pressed against the cleaning surface, against an absorber including layers of absorbing members so that a part of a liquid permeating the absorber adheres to or permeates the printing blanket; and removing a surface of the absorber to change the surface to a new surface, the removing including taking up a part of one of the absorbing members positioned in an uppermost layer of the absorber to a take-up roll, and supplying another part of the one of the absorbing members fed from a feed roll to the uppermost layer of the absorber.

7. The printing method using a printing blanket of claim 6, wherein the removing includes pressing from above the other part of the one of the absorbing members fed from the feed roll against an other part of the one of the absorbing members in an absorber upper part positioned immediately below the uppermost layer.

8. An activation device for a printing blanket, comprising:

a storage tank having a box shape;

an absorber mounted on the storage tank;

and a liquid stored in the storage tank, the absorber including layers of absorbing members and absorbing the liquid from an absorber lower part included in the absorber, the absorber including an uppermost layer and an absorber upper part fixedly positioned immediately below the uppermost layer, the uppermost layer being one of the absorbing members that is fed from a feed roll and taken up to a take-up roll, and first and second guide rollers disposed on opposite sides of the absorber upper part for guiding the uppermost layer from the feed roll to the take-up roll under tension sufficient to separate the uppermost layer and the absorber upper part by a gap, wherein the absorber upper part is closest to the uppermost layer of any part of the activation device that is disposed between the first and second guide rollers, and wherein the gap is small enough that, when the printing blanket is pressed vertically against the uppermost layer in an area between the first and second guide rollers, the uppermost layer is pressed against the absorber upper part and causes liquid from the absorber upper part to permeate the uppermost layer.

* * * * *